United States Patent [19]

Imaeda

[11] Patent Number: 4,971,006

[45] Date of Patent: Nov. 20, 1990

[54] SYNCHRONIZING MECHANISM FOR THROTTLE VALVES OF MULTIPLE CARBURETORS

[75] Inventor: Hirofumi Imaeda, Hamamatsu, Japan

[73] Assignee: Sanshin Kogyo Kabushiki Kaisha, Hamamatsu, Japan

[21] Appl. No.: 382,089

[22] Filed: Jul. 19, 1989

[30] Foreign Application Priority Data

Jul. 21, 1988 [JP] Japan ..... 63-180239

[51] Int. Cl.[5] ..... F02D 9/10

[52] U.S. Cl. ..... 123/400; 123/583; 137/595; 251/228

[58] Field of Search ..... 123/59 PC, 336, 400, 123/579, 580, 583; 137/595, 601; 251/228, 279, 305; 261/23.2

[56] References Cited

U.S. PATENT DOCUMENTS

| | | | |
|---|---|---|---|
| 2,811,862 | 11/1957 | Libby | 123/59 PC |
| 4,016,838 | 4/1977 | Yoshioka et al. | 123/59 PC |
| 4,397,792 | 8/1983 | Usui et al. | 123/59 PC X. |
| 4,577,608 | 3/1986 | DuBois et al. | 123/583 |

*Primary Examiner*—Tony M. Argenbright

*Attorney, Agent, or Firm*—Ernest A. Beutler

[57] ABSTRACT

A throttle valve synchronizing mechanism for a plurality of throttle valves interconnected by a linkage system. The synchronizing system includes a pair of pivotally supported levers one of which is fixed for rotation with one of the throttle valve shafts and the other of which is connected to the linkage system. A locking screw arrangement holds the levers in adjusted positions and the locking screw rotates about an axis that is non-parallel to the axes of the levers.

5 Claims, 5 Drawing Sheets

SYNCHRONIZING MECHANISM FOR THROTTLE VALVES OF MULTIPLE CARBURETORS

BACKGROUND OF THE INVENTION

This invention relates to a synchronizing mechanism for throttle valves of multiple carburetors and more particularly to an improved synchronizing mechanism that will insure that the throttle valves of the carburetors are in their proper positions with respect to each other.

The induction system for many internal combustion engines, particularly those having multiple combustion chambers, frequently employ a plurality of throttle valves. It is normally the practice for the throttle valves to be interconnected by means of a linkage system so that the throttle valves will all be opened and closed in unison. However, the linkage system between the individual throttle valves frequently employs an arrangment that requires some lost motion in the system so as to insure smooth operation. Where this is the case, it is important to insure that the throttle valves all are in the same position at idle so that they will all be opened at the same time and at the same rates. A variety of synchronizing mechanisms have been previously proposed for this purpose. The systems, however, have certain disadvantages inherent within them, as will now be described.

FIG. 1 illustrates a conventional prior art type of throttle control mechanism wherein the associated internal combustion engine is provided with three throttle valves having throttle valve shafts 11, 12 and 13. The throttle valve shafts 11, 12 and 13 each have affixed to them respective throttle control levers 14, 15 and 16. As is conventional, one of the throttle valves, in this instance that associated with the throttle valve shaft 11, is controlled by a follower mechanism 17 from a cam, in a manner which will be described. The lever 14 carries a pin 18 that is received within an eyelet opening in a linkage mechanism, indicated generally by the reference numeral 19, and which includes a link 21 in which this opening is formed. Corresponding links 22 and 23 are provided with openings that receive pins 24 and 25 that are affixed to the respective levers 15 and 16 so that the throttle valve shaft 11 acts as a main throttle valve and the throttle valve shafts 12 and 13 are opened as slaves.

In order to permit smooth throttle operation, the link eyelet openings have a greater diameter than the diameter of the pins 18, 14 and 25 so as to permit smooth operation. Because of this, when the throttle valve shaft 11 is rotated through an angle $\Theta$ in order to effect its opening, the pin 18 will traverse the opening in the link 21 and no movement of the throttle valve shafts 12 and 13 will occur. The throttle valve shaft 12 will not begin to open until the gap x has been closed and the throttle valve shaft 13 will not begin to open until the gap y has been closed.

In order to avoid this problem, a construction is employed wherein the link 15 is split into two link halves 26 and 27 and the link 16 is split into two link halves 28 and 29. The link halves 26 and 28 are affixed to the throttle valve shafts 12 and 13, respectively. The link halves 27 and 29 are journaled on these respective throttle valve shafts and may rotate relative to them. Lock screws 31 and 32 are incorporated so as to insure that the link halves are affixed to each other in the appropriate position to take up the lost motion at idle.

Therefore, as shown in FIG. 2, when the throttle valve shaft 11 is set in its idle position by the idle adjusting screw 33, the respective link halves 26 and 27 and 28 and 29 may be appropriately adjusted so that all of the clearances are taken up in the same direction in the throttle mechanism. However, this is a very complicated and cumbersome arrangement.

FIGS. 3 and 4 show another prior art construction which is designed so as to attempt to simplify this type of construction. As seen in these figures, the linkage system is basically the same. However, in accordance with this type of construction, a torsional spring 41 is employed in each of the split links 15 and 16 so as to bias the link halves 26, 27 and 28, 29 in opposite directions so that when the screws 31 and 32 are locked, the parts will be held in the desired relationship. Although this seems to be feasible at first, the disadvantage is that the rotation of the locking screw 31 and 32 are in the same direction as the direction of pivotal movement of the links 26, 27 and 28, 29 relative to each other. Hence, the tightening of the screws 31 and 32, because of this disadvantage, tends to cause the link halves to rotate relative to each other and disturb the adjustment. Therefore, the use of the springs 41 for taking up the lost motion and facilitating adjustment are not truly effective.

It is, therefore, a principal object of this invention to provide an improved synchronizing mechanism for the throttle valves of a plural throttle valve internal combustion engine.

It is a further object of this invention to provide an improved throttle valve synchronizing mechanism for a multiple throttle valve internal combustion engine.

It is yet another object of this invention to provide a throttle valve synchronizing mechanism including split throttle levers that are locked together by adjusting screws and wherein the locking of the adjusting screw will not tend to effect rotation of either lever half.

SUMMARY OF THE INVENTION

This invention is adapted to be embodied in a synchronizing mechanism for multiple throttle valves of an internal combustion engine. The synchronizing mechanism includes a lever assembly that is adapted to be affixed to one of the throttle valve shafts for rotating the throttle valve and for connection to another throttle valve shaft through a linkage system. The lever assembly includes a pair of pivotally connected levers, one of which is affixed to one throttle valve shaft and the other of which is adapted to be pivotally connected to the linkage system. The angular position of the two lever halves are fixed by an adjusting screw that rotates about an axis that is disposed in non-parallel relationship with the pivotal connection between the two lever halves.

DETAILED DESCRIPTION OF THE PREFERRED EMBODIMENT

Figure 1:
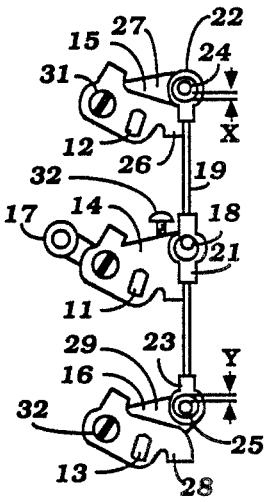
Figure 1 Prior Art
FIG. 1 is a side elevational view of a throttle linkage system constructed in accordance with a prior art method prior to synchronization of the throttle valves.
Figure 2:
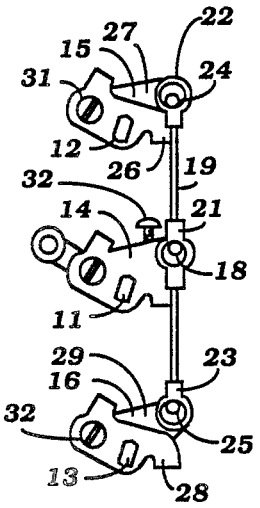
Figure 2 Prior Art
FIG. 2 is a side elevational view of the prior art construction of FIG. 1 showing the condition of the throttle valves and linkage after synchronization has been effected.
Figure 3:
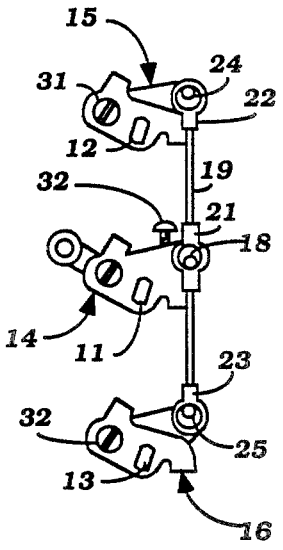
Figure 3 Prior Art
FIG. 3 is a side elevational view, in part similar to FIG. 1, showing another type of prior art construction.
Figure 4:
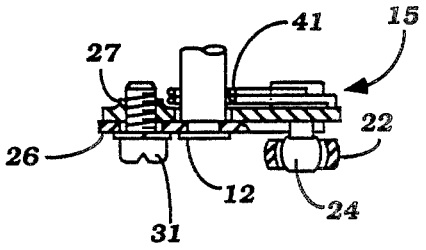
Figure 4 Prior Art
FIG. 4 is a cross-sectional view showing the synchronizing structure of this form of prior art construction.
Figure 5:
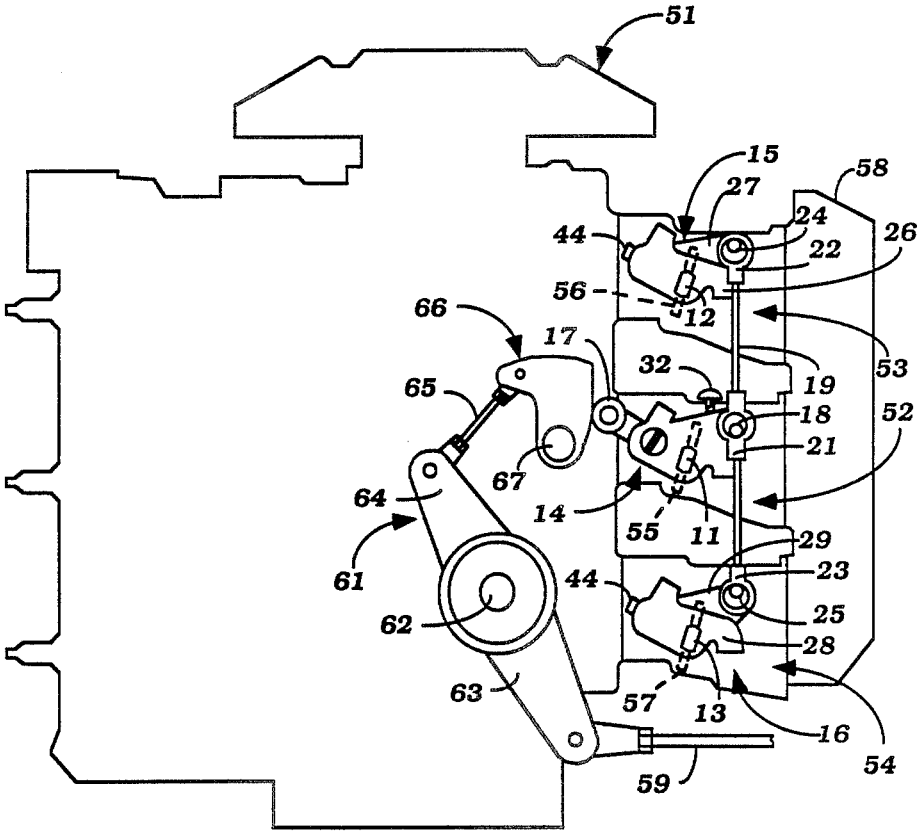
FIG. 5 is a side elevational view of the internal combustion engine of an outboard motor showing the environment in which the invention can be employed and depicting a first embodiment of the invention.
Figure 6:
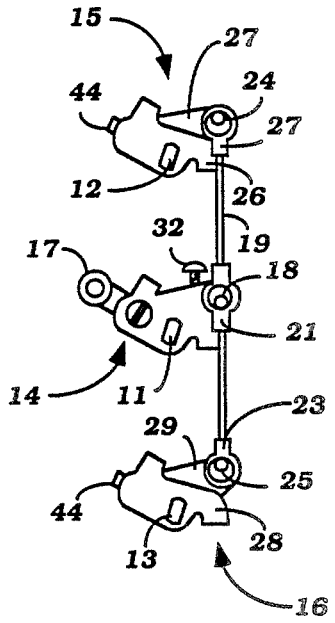
FIG. 6 is a side elevational view showing the throttle linkage and synchronizing portion.

Referring initially to FIG. 5, the invention is depicted in conjunction with an internal combustion engine 51 which forms the portion of a power head of an outboard motor. Such an embodiment is typical of the environments in which the invention can be utilized. It is to be understood, however, that the invention can be employed in conjunction with other applications and other uses for internal combustion engines and their throttle valve mechanisms.

The engine 51 is, in the illustrated embodiment, of the three cylinder in-line type and is supplied with a charge from three charge formers 52, 53 and 54. In the illustrated embodiment, the charge formers 52, 53 and 54 are depicted as being of the carburetor type and include respective throttle valves 55, 56 and 57 which are affixed to throttle valve shafts with linkage systems which, except as will hereinafter be described, are the same as the previously disclosed prior art linkage systems. For that reason, components which are substantially the same as the previously described linkage systems have been identified by the same reference numerals and will be described by reference to these reference numerals and insofar as is necessary to understand the construction and operation of the invention.

The charge forming devices 52, 53 and 54 are supplied with an air supply from an air inlet device 58 which may be of any known type and which may have any known type of construction.

The throttle control system for the engine includes a throttle actuator 59 that is connected to a remote operator control (not shown) in a known manner. This mechanism operates a throttle control lever 61 which is comprised of a bellcrank and which is pivotally supported on the engine 51 by means of a pivot shaft 62. The bellcrank 61 has a first arm portion 63 that is connected to the throttle actuator 59.

The lever arm 61 has a second arm portion 64 that is connected by means of an adjustable link 65 to a cam 66 that is pivotally supported on the engine about a shaft 67 parallel to the pivot shaft 62. The cam 66 has a cam surface that engages the follower 17 for operating the throttle valve shaft 11 of the throttle valve 55 in a known manner. The linkage system 19 further interconnects the throttle valve shafts 12 and 13 for simultaneous rotation in the manner as thus far generally described.

The synchronizing system associated with the slave carburetors 53 and 54 will be described in conjunction with the linkage system 15 associated with the carburetor throttle valve shaft 12. It is to be understood that the construction associated with the carburetor throttle valve shaft 13 is the same.

Figure 7:
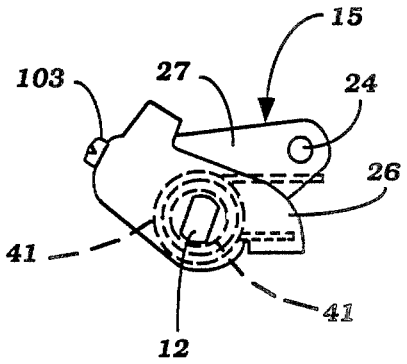
FIG. 7 is an enlarged side elevational view of the synchronizing mechanism associated with one of the slave carburetors.
Figure 8:
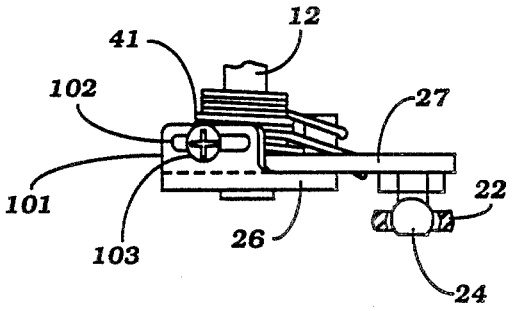
FIG. 8 is a top plan view showing this construction.

Referring now in detail to FIGS. 7 and 8, it should be noted that a torsional spring 41 is interposed between the lever portions 26 and 27 for exerting a biasing force tending to take up the lost motion in the system and for urging the associated throttle valve shaft 12 to its closed or idle position. In accordance with this embodiment of the invention, however, the lever 26 has an off turned tang portion 101 in which a circumferentially extending slot 102 is formed. The tang portion 101 overlies a corresponding tang portion formed on the lever part 27 and which has a threaded opening for receiving a locking screw 103. It should be noted that the axis of rotation of the locking screw 103 is perpendicular to the axis of rotation of the levers 26 and 27 and perpendicular to the axis of the throttle valve shaft 12. Hence, when the locking screw 103 is tightened, there will be no force exerted on any of the linkage system that tends to cause it to rotate and hence the synchronized adjustment will be readily held.

It is to be understood that the foreing description is that of a preferred embodiment of the invention and that various changes and modifications may be made without departing from the spirit and scope of the invention, as defined by the appended claims.

I claim:

1. A throttle synchronizing mechanism for the throttle valves of a multiple throttle valve internal combustion engine comprising a pair of pivotally connected levers, means for connecting one of said levers for pivotal movement about a first pivot axis with one of said throttle valves, means for connecting the other of said levers for movement with another of said throttle valves through a linkage system, and means for fixing the angular positions of said levers relative to each other including threaded fastening means rotatable about an axis non-parallel to said pivot axis so that rotation of said threader fastening means does not effect relative pivotal movement between said levers.

2. A throttle synchronizing mechanism as set forth in claim 1 wherein the one lever is affixed to the shaft of the throttle valve and the other lever is pivotal about said throttle valve shaft.

3. A throttle synchronizing mechanism as set forth in claim 1 wherein the levers have off-turned parallel tangs, the threaded fastening means being threaded into one of said tangs and passing through an elongated slot in the other of said tangs.

4. A throttle synchronizing mechanism as set forth in claim 3 further including biasing spring means interposed between said levers for urging said levers for relative rotation about their pivot axis.

5. A throttle synchronizing mechanism as set forth in claim 4 wherein the one lever is affixed to the shaft of the throttle valve and the other lever is pivotal about said throttle valve shaft.

* * * * *